US006852244B2

(12) United States Patent
Egawa et al.

(10) Patent No.: US 6,852,244 B2
(45) Date of Patent: Feb. 8, 2005

(54) LIQUID FINISHING COMPOSITION FOR TEXTILE PRODUCTS

(75) Inventors: Naoyuki Egawa, Tokyo (JP); Hiroo Miyasaka, Tokyo (JP)

(73) Assignee: Lion Corporation, Tokyo (JP)

( * ) Notice: Subject to any disclaimer, the term of this patent is extended or adjusted under 35 U.S.C. 154(b) by 0 days.

(21) Appl. No.: 10/263,657

(22) Filed: Oct. 4, 2002

(65) Prior Publication Data

US 2003/0136937 A1 Jul. 24, 2003

Related U.S. Application Data

(63) Continuation of application No. PCT/JP01/02573, filed on Mar. 28, 2001.

(30) Foreign Application Priority Data

Apr. 4, 2000 (JP) ..... 2000-101997

(51) Int. Cl.[7] ..... D06M 15/37; C08L 83/12

(52) U.S. Cl. ..... 252/8.61; 252/8.62; 252/8.63; 428/35.2; 428/35.7; 524/186; 524/236; 524/284; 524/300; 524/301; 524/588

(58) Field of Search ..... 524/186, 236, 524/284, 300, 301, 588; 428/35.2, 35.7; 252/8.61, 8.62, 8.63

(56) References Cited

U.S. PATENT DOCUMENTS 3,974,076 A * 8/1976 Wiersema et al. ..... 510/524
6,004,913 A * 12/1999 Iacobucci et al. ..... 510/123
6,051,533 A * 4/2000 Kajikawa et al. ..... 504/206
6,491,840 B1 * 12/2002 Frankenbach et al. ..... 252/8.91
6,512,015 B1 * 1/2003 Elms et al. ..... 516/118
6,579,584 B1 * 6/2003 Compton ..... 428/35.7
2002/0147128 A1 * 10/2002 Trinh et al. ..... 510/515

FOREIGN PATENT DOCUMENTS

| | | | |
|---|---|---|---|
| EP | 0 317 135 A2 | 5/1989 | |
| EP | 0 544 493 A1 | 6/1993 | |
| EP | 0 953 673 A2 | 11/1999 | |
| JP | 1-162878 | 6/1989 | |
| JP | 2-191774 | 7/1990 | |
| JP | 5-195432 | 8/1993 | |
| JP | 2000110077 A * | 4/2000 | ..... D06M/15/647 |
| WO | WO 99/55948 | 11/1999 | |

OTHER PUBLICATIONS

English Translation of JP 2000–110077, Apr. 2000, Nihei et al. obtained from the JPO Website.*

* cited by examiner

*Primary Examiner*—Jeffrey B. Robertson
(74) *Attorney, Agent, or Firm*—Burns, Doane, Swecker & Mathis, L.L.P.

(57) ABSTRACT

The present invention relates to a liquid finishing composition for textile products comprising (A) a specific modified silicone, (B) a product prepared by quaternizing a specific amine compound into a quaternary derivative thereof with methyl chloride and (C) pentaerythritol monostearate in such amounts that the ratio of (A)/(B) is equal to 30/70 (weight ratio) and which shows such effects that the composition can impart favorable softness to fibrous goods such as fibers and clothes, that it can maintain the HARI and KOSHI of the fibrous goods and which can reduce wrinkles formed due to washing.

16 Claims, 1 Drawing Sheet

LIQUID FINISHING COMPOSITION FOR TEXTILE PRODUCTS

This application is a continuation of International Application No. PCT/JP01/02573 filed on Mar. 28, 2001, and claims priority under 35 U.S.C. §§119 and/or 365 to 2000-101997 filed in Japan on Apr. 4, 2000; the entire content of which is hereby incorporated by reference.

TECHNICAL FIELD

The present invention relates to a liquid finishing composition used for textile products such as clothes. In particular, the present invention relates to a liquid finishing composition suitably used for textile products including a variety of fibrous goods such as shirts, pants and blouses, which should satisfy the requirements for softness and for natural HARI (anti-drape) upon the finish of the same.

BACKGROUND OF THE INVENTION

Conventionally, there have been used a variety of finishing agents for textile products comprising, as main components, various kinds of quaternary ammonium salts in order to impart softness or flexibility to textile products after washing. Among such quaternary ammonium salts, di-(long chain) type quaternary ammonium salts are generally used. The finishing agent for textile products comprising a di-(long chain) type quaternary ammonium salt as a main component shows an excellent softness-imparting effect, but it suffers from such problems that some of fibers and/or articles for clothes treated with the finishing agent lose their HARI and KOSHI(stiffness) depending on the kinds thereof and therefore, the use thereof is not preferred. In addition, it shows only a slight effect of reducing wrinkles formed due to washing.

On the other hand, there has been an attempt to use a silicone type compound simultaneous with the quaternary ammonium salt for the improvement of a variety of properties of a finishing agent for textile products. For instance, Japanese Un-Examined Patent Publication (hereinafter referred to as "J.P. KOKAI") No. Hei 1-162878 discloses an aqueous base formulation for conditioning fabrics, which comprises a water-dispersible cationic softener and a non-ionic softener consisting of a specific siloxane. In addition, J.P. KOKAT No. Hei 2-191774 discloses a condensed type softening and finishing agent for clothes, which comprises a quaternary ammonium salt and a specific silicone derivative. However, there has not conventionally been developed any finishing agent for textile products, which can not only impart desirable softness to textile products, but also maintain the HARI (anti-drape) and KOSHI of these textile products and likewise permits the reduction of wrinkles formed due to washing.

DISCLOSURE OF THE INVENTION

Accordingly, an object of the present invention is to provide a liquid finishing composition for textile products, which can impart desirable softness to fibrous products such as fibers and clothes, can maintain HARI, which means "anti-drape" in the whole specification, and KOSHI, which means "stiffness" in the whole specification, of the fibrous products and shows an effect of reducing the wrinkles formed during washing.

The inventors of this invention have intensively studied to achieve the foregoing object, have found that it is effective for accomplishing the foregoing object to simultaneously use a specific modified silicone and an amine compound or a neutralized product thereof or a quaternary derivative thereof in a specific ratio, simultaneous with a specific fatty acid compound and have thus completed the present invention.

According to the present invention, there is thus provided a liquid finishing composition for textile products comprising (A) at least one modified silicone represented by the following general formula (I):

(I)

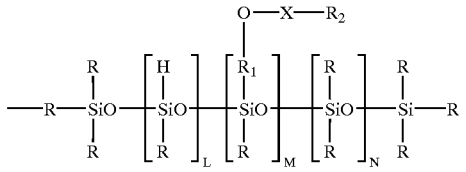

wherein R may be the same or different and each represents a saturated or unsaturated hydrocarbon group having 1 to 4 carbon atoms, $R_1$ represents a saturated or unsaturated hydrocarbon group having 1 to 4 carbon atoms, $R_2$ represents a hydrogen atom or a saturated or unsaturated hydrocarbon group having 1 to 4 carbon atoms, X represents a polyoxyalkylene group, each of L, M and N represents an average number of each corresponding repeating unit, wherein L represents a numerical value ranging from 0 to 5, M represents a numerical value ranging from 1 to 100 and N represents a numerical value ranging from 10 to 1000, provided that the rate of weight of the polyoxyethylene chain moieties present in the polyoxyalkylene group X is not less than 10% and less than 50% on the basis of the total weight of the molecule;

(B) an amine compound containing, in the molecule, at least one saturated or unsaturated hydrocarbon group having 6 to 26 carbon atoms, a neutralized product or quaternary derivative thereof or mixture thereof, wherein the rate of the compounds each containing, in the molecule, at least two saturated or unsaturated hydrocarbon groups each having 6 to 26 carbon atoms is not less than 70% by weight on the basis of the total weight of the component (B); and (C) at least one compound selected from the group consisting of $C_{10}$ to $C_{22}$ fatty acids, $C_{10}$ to $C_{22}$ fatty acid salts and esters of $C_{10}$ to $C_{22}$ fatty acids with alcohols, wherein the ratio (by weight) of Component (A):Component (B) ranges from 5:95 to 50:50.

BEST MODE FOR CARRYING OUT THE INVENTION

Figure 1:
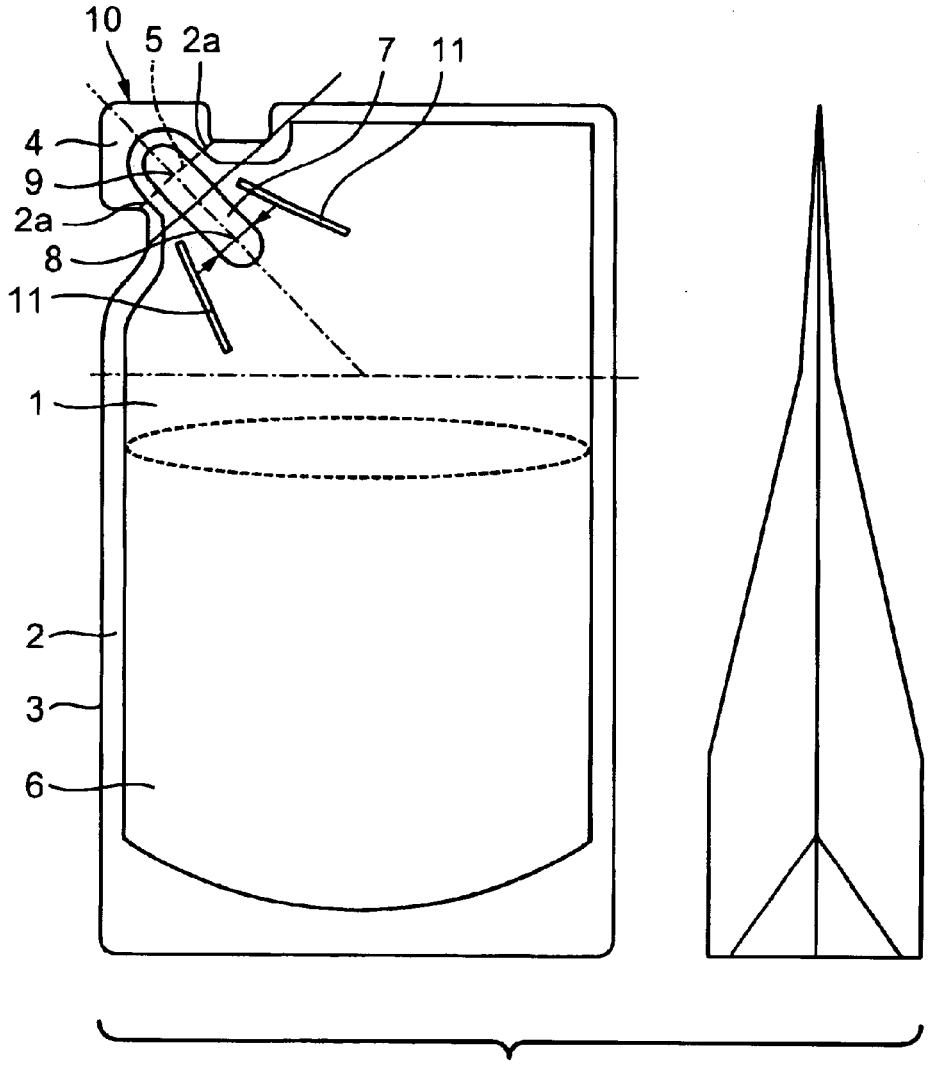
FIG. 1 shows a perspective view and a transverse cross-sectional view of a standing pouch.

The component (A) used in the present invention is a modified silicone represented by the following general formula (I):

(I)

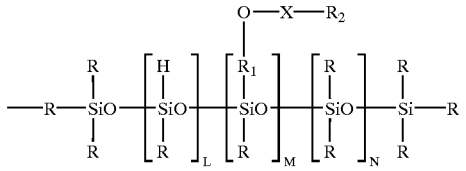

In Formula (I), the substituents represented by R may be the same or different and each of these substituents is a saturated or unsaturated hydrocarbon group having 1 to 4 carbon atoms. Specific examples of the substituent R include saturated hydrocarbon groups such as methyl, ethyl, propyl and butyl groups, with methyl group being preferred among others.

The substituent represented by $R_1$ is a saturated or unsaturated, straight or branched hydrocarbon group having 1 to 4 carbon atoms. Examples of preferred substituents $R_1$ are saturated hydrocarbon groups such as methylene, ethylene, propylene and butylene groups, with propylene group being more preferred among others.

The substituent represented by $R_2$ is a hydrogen atom or a saturated or unsaturated, straight or branched hydrocarbon group having 1 to 4 carbon atoms. When $R_2$ represents a hydrocarbon group, preferred are saturated hydrocarbon groups such as methyl, ethyl, propyl and butyl groups. Hydrogen atom is particularly preferred as the substituent $R_2$.

X represents a polyoxyalkylene group. The polyoxyalkylene group X may be, for instance, a polyoxyethylene, polyoxypropylene or polyoxybutylene group or may likewise be a group comprising oxyethylene units, oxypropylene units and/or oxybutylene units arranged randomly or in the form of blocks. In this respect, however, the rate (by weight) of the polyoxyethylene chain moieties present in the polyoxyalkylene group should be not less than 10% and less than 50% on the basis of the total weight of the molecule from the viewpoint of impartment of preferred softness to textile products and reduction of wrinkles due to washing. The rate (by weight) of the polyoxyethylene chain moieties present in the polyoxyalkylene group preferably falls within the range of from 15 to 45% and more preferably 20 to 35% on the basis of the total weight of the molecule. Moreover, the rate (by weight) of the polyoxyethylene chain moieties preferably ranges from 50 to 100% and more preferably 65 to 100% on the basis of the weight of the polyoxyalkylene group X.

Each L, M and N represents an average number of each corresponding repeating unit, and more specifically, L ranges from 0 to 5, preferably 0 to 1, M ranges from 1 to 100, preferably 1 to 50 and N ranges from 10 to 1000 and preferably 20 to 500. In this connection, the modified silicone represented by the general formula (I) may be one having a block copolymer structure in which the repeating units are arranged in blocks or one having a random copolymer structure in which the repeating units are randomly arranged.

The component (A) usable herein may be a single modified silicone represented by the general formula (I) or may comprise a plurality of different modified silicones.

The method for preparing the modified silicone represented by the general formula (I) is not limited to a particular one, but may be generally prepared by an addition reaction of silicone oil having Si—H groups with a polyether having a terminal carbon-carbon double bond.

The molecular weight of the modified silicone used in the present invention as the component (A) preferably ranges from 3,000 to 200,000 and more preferably 5,000 to 100,000.

The modified silicone as the component (A) is blended into the finishing composition of the invention in an amount ranging from 0.5 to 30% by weight and more preferably 1 to 20% by weight, in order to impart a sufficient finishing effect to the composition and to make the viscosity of the finishing composition moderate. In this connection, the amount of each component blended into the composition means the value determined when balanced with purified water or an aqueous solvent in this specification.

The component (B) used in the present invention is an amine compound containing, in the molecule, at least one saturated or unsaturated hydrocarbon group having 6 to 26 carbon atoms, a neutralized product or quaternary derivative thereof or mixture thereof. The amine compound or neutralized product or quaternary derivative thereof includes, in the molecule, at least one, preferably 1 to 3 and most preferably 2 saturated or unsaturated hydrocarbon groups having 6 to 26 and preferably 14 to 22 carbon atoms such as an alkyl group or an alkenyl group. The hydrocarbon group may include, for instance, an ester group, a inverse ester group, an amide group, a inverse amide group and/or an ether group in its chain. In this connection, these hydrocarbon groups may be introduced into the foregoing amine compound or the like through the use of currently industrially used materials such as fatty acids obtained by hydrogenating or partially hydrogenating un-hydrogenated fatty acids derived from tallow or unsaturated portion thereof; and fatty acids and fatty acid esters obtained by hydrogenating or partially hydrogenating un-hydrogenated fatty acids derived from plants such as seeds of palm trees and oil palm trees or fatty acid ester, or unsaturated portion thereof.

Examples of the amine compounds or neutralized products or quaternary derivatives thereof used as the component (B) include those represented by the following general formulas (II) to (IV):

(II)

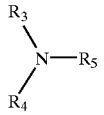

(III)

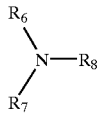

(IV)

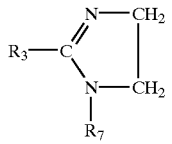

In these formulas, $R_3$ represents a saturated or unsaturated, straight or branched hydrocarbon group having 8 to 22 carbon atoms and free of any separating group such as an ester group and when it is an unsaturated hydrocarbon group, the cis/trans ratio thereof is preferably not less than 40/60;

$R_4$ is identical to $R_3$ or $R_5$;

$R_5$ is an alkyl or hydroxyalkyl group having 1 to 3 carbon atoms or a group represented by the formula: $—(CH_2—CH(Y)—O)_n—H$ (wherein Y represents a hydrogen atom or $—CH_3$ and n is a numerical value ranging from 2 to 10);

$R_6$ is a saturated or unsaturated, straight or branched hydrocarbon group having 6 to 26 carbon atoms and separated by an ester group, a inverse ester group, an amide group, a inverse amide group or an ether group, wherein when it is an unsaturated hydrocarbon group, the cis/trans ratio thereof is preferably not less than 40/60; and $R_7$ and $R_8$ are identical to $R_6$ or $R_4$.

The neutralization of the amine compound is carried out using the usual acid. Specific examples of acids are inorganic acids such as hydrochloric acid, sulfuric acid and phosphoric acid and organic acids such as benzoic acid, citric acid, malic acid, succinic acid and acrylic acid.

The quaternary derivative of the amine compound may be prepared by adding an alkyl group to a tertiary amine having a long chain alkyl group(s) according to the per-alkylation technique. Per-alkylating agents usable herein may be, for instance, dimethyl-sulfuric acid and benzyl chloride. Moreover, it is also possible to use a lower alkyl halide such as methyl iodide, methyl chloride, ethyl chloride or butyl bromide, diethyl-sulfuric acid or epichlorohydrin, in place of these per-alkylating agents.

Alternatively, the quaternary derivative of the amine compound may be prepared by acting a long chain alkyl halide on a lower tertiary amine. The long chain alkyl halide may be one having an ether bond in the chain. The long chain alkyl halide used in the reaction may be replaced with, for instance, a chloroalkyl ester such as chloromethyl ester, chloroethyl ester or chloropropyl ester, or a chloromethylated derivative of an acid amide.

The amine compounds or neutralized products or quaternary derivatives thereof may be used alone or in any combination of at least two of them.

Further improved softness can be imparted to textile products, when the rate by weight of the amine compound, the neutralized product or quaternary derivative thereof, or a mixture thereof, having at least two hydrocarbon groups, present in the component (B) used in the present invention is adjusted to a level of not less than 70% by weight and preferably 75 to 100% by weight on the basis of the total weight of the component (B).

The amine compound or the neutralized product or quaternary derivative thereof, used as the component (B) is suitably blended into the finishing composition of the present invention in an amount ranging from 3 to 50% by weight and more preferably 5 to 30% by weight on the basis of the weight of the finishing composition in order to enjoy a sufficient finishing effect and to make the viscosity of the finishing agent moderate.

The weight ratio of Component (A):Component (B) in the finishing composition for textile products according to the present invention falls within the range of from 5:95 to 50:50 and preferably 10:90 to 40:60 in order to impart favorable softness to the textile products and to simultaneously maintain the HARI and KOSHI of the products and reduce wrinkles formed due to the washing of the same.

The component (C) used herein is at least one compound selected from the group consisting of $C_{10}$to $C_{22}$ fatty acids, $C_{10}$ to $C_{22}$ fatty acid salts and esters of $C_{10}$ to $C_{22}$ fatty acids with alcohols. The incorporation of the component (C) into the finishing composition may impart more favorable softness to clothes.

The $C_{10}$ to $C_{22}$, preferably $C_{12}$ to $C_{20}$ hydrocarbon moieties present in the fatty acids and fatty acid salts may be, for instance, straight or branched, aliphatic or cyclic hydrocarbon groups. Such fatty acids may be, for instance, fats and oils derived from animals and plants and fatty acids derived from such animal and plants' fats and oils. Specific examples thereof include tallow-derived fatty acids, palm oil-derived fatty acids, soybean oil-derived fatty acids, lard-derived fatty acids, sunflower oil-derived fatty acids, olive oil-derived fatty acids, safflower oil-derived fatty acids or partially or fully hydrogenated products thereof, lauric acid, myristic acid, palmitic acid, stearic acid, oleic acid or elaidic acid, but are not restricted to these specific examples. Among these, preferably used herein are palmitic acid, stearic acid, oleic acid and elaidic acid.

When using neutral salts of fatty acids, preferred examples of such neutral salts are Na salts, K salts, Ca salts, Mg salts and triethanolamine salts, with Na salts and Ca salts being more preferably used.

Specific examples of the ester derivatives as the component (C) include those listed below: Esters of lower alcohols such as methanol, ethanol and isopropyl alcohol or trivalent to hexavalent polyhydric alcohols such as glycerin, pentaerythritol, sorbitol and triethanolamine with long chain fatty acids such as lauric acid, palmitic acid, stearic acid, oleic acid and elaidic acid. In case of esters with polyhydric alcohols, a part of the OH groups is preferably esterified rather than all of the OH groups of the alcohols are fully esterified.

Particularly preferred esters used as the component (C) are methyl stearate, methyl palmitate, methyl oleate, methyl ester of elaidic acid, monostearin and pentaerythritol monostearate.

The amount of the component (C) to be blended into the finishing composition of the present invention ranges from 0.5 to 5% by weight and preferably 0.8 to 3% by weight based on the weight of the composition. If the amount thereof falls within the range defined above, not only favorable softness can be imparted to textile products, but also the HARI and KOSHI of the products can be maintained.

The finishing composition preferably has a pH value ranging from 1 to 6 and more preferably 2 to 5 in order to improve the ability of the amine compound to be adsorbed onto fibers.

The finishing composition of the present invention may optionally comprise, for instance, additives used in the usual finishing agents for domestic use in such an amount that they never adversely affect the desired effects of the present invention. Specific examples of such additives include nonionic surfactants obtained by the addition of 5 to 100 moles, on the average, of alkylene oxide to $C_8$ to $C_{22}$ straight or branched higher alcohols, amines or methyl esters of fatty acids; higher alcohols; water-soluble salts such as common salt, ammonium chloride, calcium chloride, magnesium chloride and potassium chloride; solvents such as ethyl alcohol, isopropyl alcohol, ethylene glycol, propylene glycol, isopropylene glycol and hexylene glycol; urea; bactericides; antioxidants; dyes; pigments; hydrocarbons; cellulose derivatives; UV light absorbers; fluorescent whitenings; and perfumes.

The alkylene oxide for preparing the nonionic surfactants may be, for instance, ethylene oxide, propylene oxide and butylene oxide, with ethylene oxide being preferably used. The nonionic surfactants also include those further comprising propylene oxide and/or butylene oxide moieties in addition to ethylene oxide moieties.

The nonionic surfactant is preferably one obtained by the addition of 5 to 100 moles of ethylene oxide to a $C_8$ to $C_{22}$ straight or branched higher alcohol.

The carbon chain length of the higher alcohol used for preparing the nonionic surfactant preferably corresponds to $C_{10}$ to $C_{16}$ and more preferably $C_{12}$ to $C_{14}$. The carbon chain length of the amine or the methyl ester of fatty acid used for preparing the nonionic surfactant preferably corresponds to $C_{10}$ to $C_{18}$ and more preferably $C_{12}$ to $C_{18}$.

The average molar number of added ethylene oxide units preferably ranges from 10 to 80 and particularly preferably 20 to 60. In addition, the average molar number of propylene oxide and/or butylene oxide units added together with ethylene oxide units preferably ranges from 1 to 5 and more preferably 1 to 3. The nonionic surfactants may be prepared by adding ethylene oxide to $C_8$ to $C_{22}$ straight or branched higher alcohols, amines or methyl esters of fatty acids and then adding propylene oxide or butylene oxide to the resulting ethylene oxide adduct; or may be prepared by first adding propylene oxide or butylene oxide to $C_8$ to $C_{22}$ straight or branched higher alcohols, amines or methyl esters of fatty acids and then adding ethylene oxide to the resulting adduct; or may further be prepared by randomly adding ethylene oxide, propylene oxide and butylene oxide to $C_8$ to $C_{22}$ straight or branched higher alcohols, amines or methyl esters of fatty acids.

The amount of these optional components to be blended into the finishing composition is not restricted to any particular range inasmuch as they never adversely affect the intended effects of the finishing composition of the present invention. For instance, the nonionic surfactant is preferably blended into the composition in an amount ranging from 0.1 to 10% by weight and more preferably 0.5 to 5% by weight. The higher alcohol is preferably blended into the composition in an amount ranging from 0.1 to 5% by weight and more preferably 0.1 to 3% by weight. The water-soluble salt such as common salt or calcium chloride is preferably blended into the composition in an amount ranging from 0.05 to 3% by weight and more preferably 0.1 to 2% by weight. The solvent such as ethyl alcohol, isopropyl alcohol or ethylene glycol is preferably blended into the composition in an amount ranging from 0.1 to 20% by weight and more preferably 0.1 to 10% by weight.

A container for holding the product of the present invention may be one comprising a dispensing cap, a nozzle cap and a container body. In this respect, typical examples of materials for such dispensing cap are high-density polyethylene, low-density polyethylene, polyethylene terephthalate, polypropylene, polycarbonate and acrylic resins and the inner volume of the dispensing cap desirably ranges from 10 to 80 mL. The dispensing cap in general has a circular cross-sectional shape, but the cross-sectional shape thereof may likewise be a polygon such as a tetragonal, hexagonal or octagonal one. Moreover, the dispensing cap may optionally have markings or prints, on the internal or external surface, for dispensing the content of the container and/or may be knurled to prevent a slippage. In addition, the dispensing cap may comprise a pigment, an antistatic agent, a UV light absorber and/or a slip agent.

Moreover, the nozzle cap is a cap body blended into a cylindrical opening of the container body, wherein a partition is provided within the assembled cylinder-like member to separate the member into upper and lower portions and the partition is provided with an opening for discharging the content of the container. Materials for the nozzle cap used herein are selected from, for instance, high-density polyethylene, low-density polyethylene, polyethylene terephthalate, polypropylene, polycarbonate and acrylic resins. In addition, the nozzle cap may comprise a pigment, an antistatic agent, a UV light absorber and/or a slip agent.

The container body is selected from those prepared from materials such as high-density polyethylene, low-density polyethylene, polyethylene terephthalate, polypropylene, polycarbonate and acrylic resins. The container body may have any cross-sectional shape such as a circular shape or an ellipsoidal shape and the inner volume thereof desirably ranges from 200 to 3000 mL. It is also possible to improve the usability of the container by fitting, for instance, a handgrip and/or a label on the container. Moreover, the container body may comprise a pigment, an antistatic agent, a UV light absorber and/or a slip agent.

Alternatively, the product of the present invention may be contained in a pouch comprising a multi-layer film. FIG. 1 shows such a pouch capable of holding the product of the present invention, but FIG. 1 simply shows an embodiment of such a pouch and the pouch is not limited to any such particular embodiment.

A standing pouch 1 as shown in FIG. 1 comprises a sealed portion 2 formed by heat-sealing a plastic film, and the sealed portion 2 is provided with a guide line 5 for cutting, which separate a pouch body 3 from a portion 4 to be cut off and a tubular closed path 7 extending from a liquid agent-containing portion 6 of the pouch body to a position crossing over the guide line 5 for cutting. This closed path 7 forms a discharge path 8 for the liquid agent wherein the position corresponding to the guide line 5 for cutting serves as a discharge opening 9 for the content of the container when the portion 4 is cut along the guide line 5 for cutting. The discharge path 8 for discharge is a cylindrical body projecting towards the exterior of the container so that the liquid can easily be transferred. Ribs 11 are positioned in the proximity to the discharge path and these serve to prevent any obstruction of the discharge path due to bending of a container for refilling when transferring the liquid.

Moreover, at least a portion of the discharge path 8 in the proximity to the discharge opening 9 is shaped in such a manner that the portion is projected from the pouch body 3 along with the sealed portions 2*a*, 2*a* formed on and under the discharge path. The shape of the discharge port 10 is not limited to any specific one. The discharge path is preferably arranged at the upper part of the container, in particular, a corner thereof. The discharge port may be realized by cutting with scissors or by manually tearing off the desired part of the container. Such a container capable of being manually torn can be obtained by appropriately devising the construction or structure of the film or by forming at least one continuous cutting line using a carbon dioxide gas laser or by forming a perforation. Moreover, a pipe may be fitted to the discharge port.

Examples of materials for forming multi-layer films are nylon, polyethylene, polypropylene, ethylene-vinyl alcohol copolymer and polyethylene terephthalate from the viewpoint of the quality stability and fragrance stability of the contents of the container, the strength of the pouch and the usability of the container and from the economical standpoint. In the multi-layer film, at least two such materials are used, but at least two films identical to one another may be used. Among the materials, multi-layer films desirably comprise at least two members selected from nylon, polyethylene, polypropylene and polyethylene terephthalate. When preparing a pouch using a multi-layer film, a plurality of films can be laminated and then heat-sealed, but the method for preparing the pouch is not limited to any particular one.

The thickness of the pouch preferably falls within the range of from 20 to 400 $\mu$m from the viewpoint of the quality stability and fragrance stability of the contents of the container and the strength of the packaging body and from the economical standpoint. If the thickness is less than 20 $\mu$m, the strength of the packaging body is reduced and this would result in the leakage of the content thereof upon, for instance, accidental dropping during transportation. On the other hand, if the thickness exceeds 400 $\mu$m, the production cost thereof increases and the environmental load is also high. Moreover, the overall hardness of the packaging body increases and this leads to the deterioration of the usability thereof when the consumers practically use the same.

The finishing composition for textile products according to the present invention can be prepared by dissolving or dispersing the Components (A), (B) and (C) as well as optional components in purified water or an aqueous solvent. In this case, examples of solvents usable herein are lower alcohols such as ethanol and isopropanol and polyhydric alcohols such as ethylene glycol, propylene glycol, glycerin and hexylene glycol.

In addition, the finishing composition for textile products according to the present invention is desirably used in such an amount that the concentration of the component (B) ranges from 20 to 300 ppm and more desirably 45 to 200 ppm on the basis of the total amount of water practically used for finishing textile products.

EXAMPLES

The present invention will be illustrated in more detail below with reference to the following Examples, but the present invention is not limited to these specific Examples at all.

Component (A)

In the following Examples, modified silicones used were modified silicones A-1 to A-5 of the present invention and a modified silicone A-6 as a comparative sample, having structures listed in the following Table 1, respectively.

TABLE 1

| | Chemical Structure | | | | | | Rate (% by weight) of POE Chains in Group X Relative to Entire Molecule (*1) | |
|---|---|---|---|---|---|---|---|---|
| | R | R1 | R2 | L | M | N | | |
| A-1 | $CH_3$ | $C_3H_6$ | H | 0 | 3 | 75 | 20 | (POE/POP = 100/0) |
| A-2 | $CH_3$ | $C_3H_6$ | H | 0 | 3 | 45 | 28 | (POE/POP = 100/0) |
| A-3 | $CH_3$ | $C_3H_6$ | H | 0 | 3 | 28 | 38 | (POE/POP = 100/0) |
| A-4 | $CH_3$ | $C_3H_6$ | H | 1 | 6 | 150 | 20 | (POE/POP = 100/0) |
| A-5 | $CH_3$ | $C_3H_6$ | H | 0 | 10 | 115 | 32 | (POE/POP = 50/50) |
| A-6 | $CH_3$ | $C_3H_6$ | H | 0 | 3 | 7 | 67 | (POE/POP = 100/0) |

(*1): The term enclosed in parentheses represents the molar ratio of added polyoxyalkylene groups.
POE: polyoxyethylene;
POP: polyoxypropylene.

Component (B)

Compounds B-1 to B-14 having structures specified in the following Table 2 were used as the amine compounds or the neutralized products or quaternary derivatives thereof.

TABLE 2

| | Chemical Structure |
|---|---|
| B-1 | A product obtained by quaternizing an amine compound represented by Formula (II) with methyl chloride (provided that $R_3$ and $R_4$ are hydrocarbon groups each having 18 carbon atoms and $R_5$ is a methyl group) |
| B-2 | A product obtained by quaternizing an amine compound represented by Formula (II) with methyl chloride (provided that $R_3$ is a hydrocarbon group having 18 carbon atoms and $R_4$ and $R_5$ are methyl groups) |
| B-3 | A product obtained by quaternizing an amine compound represented by Formula (III) with methyl chloride (provided that $R_6$ and $R_7$ are acyloxyethyl groups each having 20 carbon atoms in all and $R_8$ is a methyl group) |
| B-4 | A product obtained by quaternizing an amine compound represented by Formula (III) with methyl chloride (provided that $R_6$ is an acyloxyethyl group having 20 carbon atoms in all, $R_7$ is a $C_2H_4OH$ group and $R_8$ is a methyl group) |
| B-5 | A product obtained by quaternizing an amine compound represented by Formula (III) with dimethyl-sulfuric acid (provided that $R_6$ and $R_7$ are acyloxyethyl groups each having 20 carbon atoms in all and $R_8$ is a $C_2H_4OH$ group) |
| B-6 | A product obtained by quaternizing an amine compound represented by Formula (III) with dimethyl-sulfuric acid (provided that $R_6$ is an acyloxyethyl group having 20 carbon atoms in all, and $R_7$ and $R_8$ are $C_2H_4OH$ groups, respectively) |
| B-7 | A product obtained by quaternizing an amine compound represented by Formula (III) with dimethyl-sulfuric acid (provided that $R_6$, $R_7$ and $R_8$ are acyloxyethyl groups each having 20 carbon atoms in all) |

TABLE 2-continued

| | Chemical Structure |
|---|---|
| B-8 | A product obtained by quaternizing an amine compound represented by Formula (III) with methyl chloride (provided that $R_6$ is an acyloxyethyl group having 20 carbon atoms in all, $R_7$ is an acylaminopropyl group having 21 carbon atoms in all and $R_8$ is a methyl group) |
| B-9 | A hydrochloride of an amine compound represented by Formula (II) (provided that $R_3$ and $R_4$ are hydrocarbon groups each having 18 carbon atoms and $R_5$ is a methyl group) |
| B-10 | A hydrochloride of an amine compound represented by Formula (III) (provided that $R_6$ and $R_7$ are acyloxyethyl groups each having 20 carbon atoms in all and $R_8$ is a methyl group) |
| B-11 | A methyl-sulfate of an amine compound represented by Formula (III) (provided that $R_6$ and $R_7$ are acyloxyethyl groups each having 20 carbon atoms in all and $R_8$ is a $C_2H_4OH$ group) |
| B-12 | A hydrochloride of an amine compound represented by Formula (III) (provided that $R_6$ is an acyloxyethyl group having 20 carbon atoms in all, $R_7$ is an acylaminopropyl group having 21 carbon atoms in all and $R_8$ is a methyl group) |
| B-13 | An amine compound represented by Formula (IV) (provided that $R_3$ is a hydrocarbon group having 17 carbon atoms and $R_7$ is an acylaminoethyl group having 20 carbon atoms in all) |
| B-14 | A methyl-sulfate of an amine compound represented by Formula (III) (provided that $R_6$, $R_7$ and $R_8$ are acyloxyethyl groups each having 20 carbon atoms in all) |

The long chain hydrocarbon group-containing compounds B-1, B-2, B-9 and B-13 were prepared from mixtures of saturated fatty acids each having 18 carbon atoms with unsaturated fatty acids each containing one unsaturated group having 18 carbon atoms, the ultimate weight ratio of saturated hydrocarbon group/unsaturated hydrocarbon group thereof was found to be 80/20 and the ratio of stereoisomers of the unsaturated hydrocarbon groups or the cis/trans ratio was found to be 45/55. The aforementioned acyloxyethyl group and acylaminoethyl group (Compounds B-3 to B-7, B-10, B-11, B-13 and B-14) were derived from mixtures of saturated fatty acids each having 18 carbon atoms with unsaturated fatty acids each carrying one unsaturated group having 18 carbon atoms, the ultimate weight ratio of saturated acyl group/unsaturated acyl group thereof was found to be 60/40 and the ratio of stereoisomers of the unsaturated acyl groups or the cis/trans ratio was found to be 45/55. Further the acyloxyethyl group and acylaminopropyl ethyl group (Compounds B-8, B-12) were derived from saturated fatty acids having 18 carbon atoms and saturated fatty acids having 16 carbon atoms and the ultimate weight ratio of $C_{18}/C_{16}$ was found to be 70/30.

Component (C)

In Examples, compounds C-1 to C-3 and a compound C-4 as a comparative sample specified in the following Table 3 were used as the $C_{10}$ to $C_{22}$ fatty acids or the fatty acid salts or ester derivatives thereof.

TABLE 3

| | Component (C) |
|---|---|
| C-1 | Stearic acid |
| C-2 | Stearic acid/methyl palmitate = 7/3 (weight ratio) |
| C-3 | Pentaerythritol monostearate |
| C-4 | Hexanoic acid |

Preparation of Finishing Composition

There were emulsified and dispersed, in purified water as the balance, components (A) to (C) in amounts specified in the following Tables 4 and 5, as well as 1% by weight of isotridecyl alcohol-ethylene oxide adduct (average added molar amount: 40), 0.3% by weight of calcium chloride, 3% by weight of ethylene glycol, 0.6% by weight of a perfume, 3% by weight of brucine-denatured ethanol, 0.2% by weight of polyethylene glycol (average molecular weight: 1500), 0.01% by weight of Kathon CG (available from Rohm & Haas Co.), 10 ppm of Acid Red 138and a pH controlling agent (hydrochloric acid, sodium hydroxide) as optional components, to thus prepare each corresponding finishing composition. The compositions of the perfumes blended into the finishing composition are specified in the following Table 6.

TABLE 4

| Comparative Example | A (% by weight) | B (% by weight) | C (% by weight) | A/B | Ratio[1)] (% by weight) |
|---|---|---|---|---|---|
| 1 | | B-1 (9.4)<br>B-2 (0.5)<br>B-9 (0.1) | | 0/100 | 95 |
| 2 | A-6 (2.0) | B-1 (7.5)<br>B-2 (0.4)<br>B-9 (0.1) | | 20/80 | 95 |
| 3 | A-1 (7.0) | B-1 (3.0) | | 70/30 | 100 |
| 4 | A-1 (2.0) | B-3 (6.2)<br>B-4 (1.5)<br>B-10 (0.3) | C-4 (1.0) | 20/80 | 81 |
| 5 | A-1 (2.0) | B-5 (1.0)<br>B-6 (7.0) | C-1 (2.0) | 20/80 | 12 |

[1)]The rate (% by weight) of amines, amine salts, quaternary derivatives having at least two long chain hydrocarbon groups present in the component (B).
* A/B = weight ratio

TABLE 5

| Example | A (% by weight) | B (% by weight) | C (% by weight) | A/B | Ratio[1)] (% by weight) |
|---|---|---|---|---|---|
| 1 | A-1 (2.0) | B-1 (7.5)<br>B-2 (0.4)<br>B-9 (0.1) | C-1 (1.0) | 20/80 | 95 |
| 2 | A-2 (2.0) | B-1 (7.5)<br>B-2 (0.4)<br>B-9 (0.1) | C-2 (1.0) | 20/80 | 95 |
| 3 | A-1 (2.0) | B-3 (6.2)<br>B-4 (1.5)<br>B-10 (0.3) | C-2 (1.5) | 20/80 | 81 |
| 4 | A-5 (4.3) | B-8 (10.0) | C-3 (1.0) | 30/70 | 100 |
| 5 | A-3 (5.4) | B-12 (8.0) | C-1 (1.0) | 40/60 | 100 |
| 6 | A-2 (1.5) | B-13 (10.0) | C-3 (1.0) | 13/87 | 100 |
| 7 | A-2 (1.5) | B-5 (5.6)<br>B-6 (2.6)<br>B-7 (1.6)<br>B-11 (0.2)<br>B-14 (1.5) | C-1 (2.0) | 12/88 | 77 |
| 8 | A-1 (3.5) | B-5 (7.4)<br>B-6 (3.4)<br>B-7 (2.0)<br>B-11 (0.2)<br>B-14 (2.0) | C-2 (1.0) | 19/81 | 77 |

[1)]The rate (% by weight) of amines, amine salts, quaternary derivatives having at least two long chain hydrocarbon groups present in the component (B).
* A/B = weight ratio

TABLE 6

Perfume Composition

| Component | Amount (% by weight) |
|---|---|
| Eugenol | 0.5 |
| Geraniol | 1.0 |
| Bacdanol | 2.0 |
| Dipropylene glycol | 3.0 |
| Linalool | 3.0 |
| Phenylethyl alcohol | 5.0 |
| 9-Decene-1-ol | 0.1 |
| Citronellol | 2.0 |
| Isoeugenol | 0.1 |
| Cedrol | 0.4 |
| Cis-3-hexenol | 3.0 |
| Nerol | 1.0 |
| Terpineol | 3.0 |
| Borneol | 0.2 |
| Cis-3-hexenyl salicylate | 3.0 |
| Dibutyl hydroxytoluene | 0.5 |
| Methyl atrarate | 0.1 |
| Menthol | 0.3 |
| Nonanal | 0.2 |
| Decanal | 0.2 |
| Undecanal | 0.2 |
| 2-Methyl undecanal | 0.1 |
| Anisaldehyde | 2.0 |
| Heliotropin | 1.0 |
| Hexyl cinnamic aldehyde | 2.0 |
| Lilial | 4.0 |
| Lyral | 2.0 |
| Vanillin | 0.1 |
| Ethyl vanillin | 0.1 |
| Muscone | 0.1 |
| Cyclohexadecenone | 1.0 |
| Musk ketone | 0.5 |
| Tonalide | 5.0 |
| Ionone | 0.2 |
| Methyl ionone | 3.0 |
| Iso E Supar | 6.0 |
| β-Methyl naphthyl ketone | 0.1 |
| Cashmeran | 0.2 |
| Damascone | 0.3 |
| Geranyl acetate | 0.2 |
| Citronellyl acetate | 0.5 |
| Phenylethyl acetate | 1.0 |
| Methyl dihydrojasmonate | 5.0 |
| Benzyl acetate | 4.0 |
| Linalyl acetate | 2.0 |
| Terpinyl acetate | 2.0 |
| Acetyl cedrene | 2.0 |
| p-tert-Butylcyclohexyl acetate | 2.0 |
| 2-tert-Butylcyclohexyl acetate | 0.3 |
| Methyl anthranilate | 0.2 |
| Dimethylbenzyl carbinyl acetate | 2.0 |
| Limonene | 6.0 |
| Pinene | 2.0 |
| Myrcene | 1.0 |
| Caryophyllene | 1.0 |
| Cyclopentadecanolide | 1.0 |
| γ-Decalactone | 0.1 |
| γ-Undecalactone | 0.2 |
| Coumarin | 1.0 |
| Galaxolide | 6.0 |
| Orange oil | 2.0 |
| Ambroxan | 0.3 |
| Farenal | 0.2 |
| Geranyl nitrile | 0.3 |
| Lavandin oil | 1.0 |
| Indole | 0.2 |
| Total | 100 |

With respect to the foregoing finishing compositions, those prepared in Comparative Examples 1 to 4 and Examples 1 to 2 were adjusted to pH values of 5.0, while those prepared in Comparative Example 5 and Examples 3 to 8 were controlled to pH values of 3.0.

Evaluating Method for Finishing Compositions (1) Finishing Treatment with Finishing Agents Commercially available Dungaree Shirt (100% cotton) was washed in an electric washing machine using a commercially available detergent "Super Top" (available from Lion Corporation). Then 20 g of each finishing composition listed in Table 5 per 30 L of rinse water was added during the third rinsing step to subject clothes to a finishing treatment. Thereafter, the clothes were air-dried under the conditions of a temperature of 20° C. and an RH of 40% using hangers and then evaluated for the following properties.

(2) These finishing compositions were examined by the sensory pair-comparison test using 5 professional panelists while using, as a control, Dungaree Shirt finished with the composition of Comparative Example 1 specified in Table 4 and evaluated according to the following evaluation criteria shown in the following Table 7.

TABLE 7

| Dungaree Shirt | | | |
|---|---|---|---|
| Evaluation marks (as compared with control) | Softness | HARI, KOSHI | Degree of Wrinkles observed after drying |
| +2 | Distinctly softer than that observed for the control | HARI and KOSHI distinctly higher than those observed for the control | Distinctly smaller than those observed for the control |
| +1 | Slightly softer than that observed for the control | HARI and KOSHI slightly higher than those observed for the control | Slightly smaller than those observed for the control |
| 0 | Almost identical to that observed for the control | HARI and KOSHI almost identical to those observed for the control | Almost identical to those observed for the control |
| −1 | Slightly inferior to that observed for the control | HARI and KOSHI slightly inferior to those observed for the control | Slightly larger than those observed for the control |
| −2 | Distinctly inferior to the softness observed for the control | HARI and KOSHI distinctly inferior to those observed for the control | Distinctly larger than those observed for the control |

The results thus obtained are summarized in the following Table 8.

TABLE 8

| Dungaree Shirt | | | |
|---|---|---|---|
| Ex. No. | Softness | HARI, KOSHI | Degree of Wrinkles after drying |
| Comp. Ex. 1 | 0 | 0 | 0 |
| Comp. Ex. 2 | 0 | 0 | 0 |

TABLE 8-continued

| Dungaree Shirt | | | |
|---|---|---|---|
| Ex. No. | Softness | HARI, KOSHI | Degree of Wrinkles after drying |
| Comp. Ex. 3 | −2 | +1 | −1 |
| Comp. Ex. 4 | 0 | +2 | +2 |
| Comp. Ex. 5 | −1 | +2 | +1 |
| Ex. 1 | +1 | +2 | +2 |
| Ex. 2 | +1 | +2 | +1 |
| Ex. 3 | +1 | +2 | +2 |
| Ex. 4 | +1 | +1 | +1 |
| Ex. 5 | +1 | +2 | +1 |
| Ex. 6 | +1 | +2 | +2 |
| Ex. 7 | +1 | +1 | +2 |
| Ex. 8 | +1 | +2 | +1 |

The present invention permits not only the impartment of favorable softness to textile products, but also the maintenance of desired HARI and KOSHI of the products and the reduction of wrinkles formed due to the washing of the same, through the simultaneous use of a specific modified silicone; an amine compound or a neutralized product or quaternary derivative thereof; and a specific fatty acid compound in a finishing composition.

What is claimed is:

1. A liquid finishing composition for textile products comprising:

(A) at least one modified silicone represented by the following general formula (I):

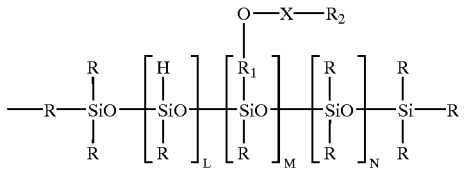

(I)

wherein R may be the same or different and each represents a saturated or unsaturated hydrocarbon group having 1 to 4 carbon atoms, $R_1$ represents a saturated or unsaturated hydrocarbon group having 1 to 4 carbon atoms, $R_2$ represents a hydrogen atom or a saturated or unsaturated hydrocarbon group having 1 to 4 carbon atoms, X represents a polyoxyalkylene group, each of L, M and N represents an average number of each corresponding repeating units, wherein L represents a numerical value ranging from 0 to 5, M represents a numerical value ranging from 1 to 100 and N represents a numerical value ranging from 10 to 1000, provided that the rate of weight of the polyoxyethylene chain moieties present in the polyoxyalkylene group X is not less than 10% and less than 50% on the basis of the total weight of the molecule;

(B) an amine compound containing, in the molecule, at least one saturated or unsaturated hydrocarbon group having 6 to 26 carbon atoms, a neutralized product or quaternary derivative thereof or mixture thereof, wherein the rate of the compounds each containing, in the molecule, at least two saturated or unsaturated hydrocarbon groups each having 6 to 26 carbon atoms is not less than 70% by weight on the basis of the total weight of the component (B); and (C) at least one compound selected from the group consisting of $C_{10}$ to $C_{22}$ fatty acids, $C_{10}$ to $C_{22}$ fatty acid salts and esters of $C_{10}$ to $C_{22}$ fatty acids with alcohols, wherein the ratio (by weight) of Component (A):Component (B) ranges from 5:95 to 50:50.

2. The liquid finishing composition for textile products according to claim 1, wherein in the general formula (I), R represents a methyl, ethyl, propyl or butyl group, $R_1$ represents a methylene, ethylene, propylene or butylene group, $R_2$ represents a hydrogen atom or a methyl, ethyl, propyl or butyl group, provided that the rate of weight of the polyoxyethylene chain moieties present in the polyoxyalkylene group X is not less than 10% and less than 50% on the basis of the total weight of the molecule, L ranges from 0 to 1, M ranges from 1 to 50 and N ranges from 20 to 500.

3. The liquid finishing composition for textile products according to claim 1, wherein the liquid finishing composition comprises the modified silicone represented by the general formula (I) and used as the component (A) in an amount ranging from 0.5 to 30% on the basis of the total weight of the composition.

4. The liquid finishing composition for textile products according to claim 1, wherein the component (B) is at least one member selected from amine compounds represented by the following general formulas (II) to (IV) or neutralized products or quaternary derivatives thereof:

(II)

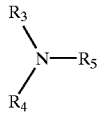

(III)

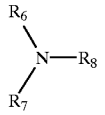

(IV)

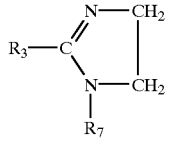

wherein, $R_3$ represents a saturated or unsaturated, straight or branched hydrocarbon group having 8 to 22 carbon atoms and free of any separating group;

$R_4$ is identical to $R_3$ or $R_5$;

$R_5$ is an alkyl or hydroxyalkyl group having 1 to 3 carbon atoms or a group represented by the formula: $—(CH_2—CH(Y)—O)_n—H$ (wherein Y represents a hydrogen atom or $—CH_3$ and n is a numerical value ranging from 2 to 10);

$R_6$ is a saturated or unsaturated, straight or branched hydrocarbon group having 6 to 26 carbon atoms and separated by an ester group, a inverse ester group, an amide group, an inverse amide group or an ether group; and $R_7$ and $R_8$ are identical to $R_6$ or $R_4$.

5. The liquid finishing composition for textile products according to claim 4, wherein the component (B) is at least one member selected from amine compounds represented by the general formula (III) or neutralized products or quaternary derivatives thereof.

6. The liquid finishing composition for textile products according to claim 1, wherein the rate of the compounds containing at least two hydrocarbon groups, present in the component (B) ranges from 75 to 100% by weight on the basis of the total weight of the component (B).

7. The liquid finishing composition for textile products according to claim 1, wherein the component (C) is a member selected from the group consisting of tallow-derived fatty acids, palm oil-derived fatty acids, soybean oil-derived fatty acids, lard-derived fatty acids, sunflower oil-derived fatty acids, olive oil-derived fatty acids, safflower oil-derived fatty acids or partially or fully hydrogenated products thereof; lauric acid, myristic acid, palmitic acid, stearic acid or oleic acid; Na salts, K salts, Ca salts, Mg salts or triethanolamine salts of these fatty acids; and esters of these fatty acids with lower alcohols or 3 to 6 valent polyhydric alcohols.

8. The liquid finishing composition for textile products according to claim 7, wherein the component (C) is a member selected from the group consisting of palmitic acid, stearic acid, oleic acid or elaidic acid; Na salts and Ca salts of these fatty acids; and methyl stearate, methyl palmitate, methyl oleate, methyl elaidate, monostearin and pentaerythritol monostearate.

9. The liquid finishing composition for textile products according to claim 1, wherein the component (C) is blended into the finishing composition in an amount ranging from 0.5 to 5% by weight on the basis of the total weight of the composition.

10. The liquid finishing composition for textile products according to claim 1, wherein it further comprises a nonionic surfactant prepared by adding 5 to 100 moles of alkylene oxides on the average to $C_8$ to $C_{22}$ straight or branched higher alcohols, amines or methyl esters of fatty acids.

11. The liquid finishing composition for textile products according to claim 1, wherein it further comprises at least one member selected from the group consisting of ethyl alcohol, isopropyl alcohol, ethylene glycol, propylene glycol, isopropylene glycol and hexylene glycol.

12. The liquid finishing composition for textile products according to claim 1, wherein the balance of the composition is purified water.

13. The liquid finishing composition for textile products according to claim 1, wherein it has a pH value ranging from 1 to 6.

14. A liquid finishing composition for textile products packaged in a pouch which comprises:

a pouch comprising a multi-layer film and the liquid finishing composition for textile products according to claim 1 packed in the pouch.

15. The liquid finishing composition for textile products packaged in a pouch according to claim 14, wherein the multi-layer film comprises at least two members selected from the group consisting of nylon, polyethylene, polypropylene and polyethylene terephthalate and the thickness of the pouch ranges from 20 to 400 $\mu$m.

16. A method for finishing textile products comprising the steps of:

diluting a liquid finishing composition according to claim 1 with water to obtain a solution having a concentration of the component (B) ranging from 20 ppm to 300 ppm with respect to the amount of water, and applying the resulting solution to textile products to finish the textile products.

* * * * *